US006161746A

United States Patent [19]

Wey

[11] Patent Number: 6,161,746

[45] Date of Patent: Dec. 19, 2000

[54] NAIL MAGAZINE STRUCTURE FOR NAIL EJECTION GUN

[75] Inventor: Fwu-Lai Wey, No. 38, Lane 32, Nan-King Road, Taichung, Taiwan

[73] Assignees: Fwu-Lai Wey, Taichung; Yao-Tang Chen, Taipei, both of Taiwan

[21] Appl. No.: 09/597,718

[22] Filed: Jun. 19, 2000

[30] Foreign Application Priority Data

Oct. 30, 1999 [TW] Taiwan ..... 088218664

[51] Int. Cl.[7] ..... B25C 1/04

[52] U.S. Cl. ..... 227/109; 227/120

[58] Field of Search ..... 227/109, 120, 227/136, 137, 138, 119

[56] References Cited

U.S. PATENT DOCUMENTS

| | | | |
|---|---|---|---|
| 3,834,602 | 9/1974 | Obergfell | 227/109 |
| 5,522,533 | 6/1996 | Mukoyama et al. | 227/109 |
| 5,632,431 | 5/1997 | Lin | 227/120 |
| 5,692,665 | 12/1997 | Lee | 227/119 |
| 5,873,509 | 2/1999 | Liao | 227/120 |
| 5,934,539 | 8/1999 | Lee | 227/109 |
| 5,967,396 | 10/1999 | Chuang | 227/120 |

*Primary Examiner*—Scott A. Smith
*Attorney, Agent, or Firm*—Rosenberg, Klein & Lee

[57] ABSTRACT

A nail magazine structure for a nail ejection gun includes a first nail magazine defining a plurality of slide grooves, a catch piece secured on the first nail magazine, a cover plate secured on the catch piece, a nail receiving chamber defined between the first nail magazine, the catch piece and the cover plate, a second nail magazine secured on the first nail magazine and defining a plurality of spring receiving grooves each aligning with the slide grooves and each defining a receiving channel, a plurality of springs each received in a respective spring receiving groove, a primary push pin secured on one of the springs to be pressed upward by the spring, a nail push piece secured on the primary push pin to move upward in the nail receiving chamber, a plurality of push pins each secured on a respective spring to be pressed upward by the spring, and a plurality of nail limit pieces each secured on a respective push pin to move upward in the receiving channels and the slide grooves.

7 Claims, 7 Drawing Sheets

NAIL MAGAZINE STRUCTURE FOR NAIL EJECTION GUN

BACKGROUND OF THE INVENTION

1. Field of the Invention

The present invention relates to a nail magazine structure, and more particularly to a nail magazine structure for a nail ejection gun.

2. Description of the Related Art

A conventional nail magazine structure 20 for a nail ejection gun 10 in accordance with the prior art shown in FIGS. 1–8 is vertically secured on the bottom of a leading guide plate 11 of the nail ejection gun 10 and comprises two symmetrical magazine bodies 21 between which a nail receiving chamber 218 is defined. Each of the two magazine bodies 21 defines a longitudinal slide groove 211 which defines a plurality of oblong slots 212. A plurality of limit pieces 22 are secured between the two magazine bodies 21 by screws 241 and nuts 242. Each of the limit pieces 22 includes a plurality of stubs 221 extending laterally to be received in through holes 213 defined in the magazine body 21. A slide piece 23 is slidably mounted between two adjacent limit pieces 22 and defines a plurality of oblique slots 231 which align with the oblong slots 212 of the magazine bodies 21.

One of the two magazine bodies 21 defines a spring receiving hole 214 for receiving a spring 215 and a ball 216. A U-shaped push bracket 25 is slidably mounted on the two magazine bodies 21 and defines a plurality of positioning sockets 251 for receiving the ball 216.

The push bracket 25 also defines a plurality of through holes 252. A plurality of push pins 26 each extend through the through hole 252 of the push bracket 25, through the oblong slots 212 of the magazine bodies 21, and through the oblique slot 231 of the slide piece 23, and are each secured by a snap ring 261. When the push bracket 25 is moved on the magazine bodies 21, each of the push pins 26 is moved in the oblong slot 212 and in the oblique slot 231, thereby moving the slide piece 23 in a sideward manner.

A positioning base 28 is secured on the bottom of the magazine bodies 21, and includes two hooks 281 hooked on the positioning pin 217 of the magazine bodies 21. A support base 27 is secured on the magazine bodies 21 by the positioning base 28, and defines a receiving channel 271. A plurality of positioning rods 272 are secured in the receiving channel 271 by screws 273. A plurality of springs 274 are mounted on the positioning rods 272 for pressing a nail push slide block 275 upward which includes a nail push piece 276 mounted between the two magazine bodies 21 for pressing the nails 30 upward.

In operation, the push bracket 25 is moved upward on the magazine bodies 21, whereby each of the push pins 26 is moved in the oblong slot 212 of the magazine body 21 and in the oblique slot 231 of the slide piece 23, thereby pushing and moving the slide piece 23 from the position as shown in FIG. 3 to the position as shown in FIG. 5, and further to the position as shown in FIG. 7 so that the width of the nail receiving chamber 218 can be adjusted for receiving nails 30 of different lengths therein.

The push bracket 25 defines a viewing window 253 aligning with the numerals (not numbered) on the magazine body 21 so that the user can inspect the width of the nail receiving chamber 218 so as to place nails 30 of different lengths in the nail receiving chamber 218.

However, the nails 30 are pressed and supported by the single nail push piece 276 so that the nails 30 are easily disposed in an oblique manner in the nail receiving chamber 218 during the upward movement of the nails 30 so that the nails 30 are not in a horizontal state when they are built into the nail ejection gun 10, thereby decreasing the precision of action of the nail ejection gun 10, and thereby causing inconvenience to the user.

In addition, the user has to manually adjust the width of the nail receiving chamber 218 by moving the push bracket 25. If the width of the nail receiving chamber 218 does not fit the length of the nails 30, the nails 30 easily move sideward in the nail receiving chamber 218 so that the nails 30 are easily disposed in an oblique manner in the nail receiving chamber 218 during the upward movement of the nails 30 so that the nails 30 are not in an entire horizontal state when they are built into the nail ejection gun 10, thereby decreasing the precision of action of the nail ejection gun 10, and thereby causing inconvenience to the user.

SUMMARY OF THE INVENTION

In accordance with one aspect of the present invention, there is provided a nail magazine structure for a nail ejection gun comprising: a first nail magazine defining a plurality of longitudinal slide grooves therein, an elongated catch piece secured on the first nail magazine, an elongated cover plate secured on the catch piece for securing the catch piece on the first nail magazine, a nail receiving chamber defined between the first nail magazine, the catch piece and the cover plate; a second nail magazine secured on the first nail magazine and defining a plurality of spring receiving grooves each aligning with each of the slide grooves of the first nail magazine, each of the spring receiving grooves defining a receiving channel therein; a plurality of springs each received in a respective one of the spring receiving grooves; a primary push pin secured on a first one of the springs to be pressed upward by the spring; a nail push piece secured on the primary push pin to be pushed upward by the primary push pin to move upward in the nail receiving chamber; a plurality of push pins each secured on a respective one of the springs to be pressed upward by the springs; and a plurality of nail limit pieces each secured on a respective one of the push pins to be pushed upward by the push pins to move upward in the receiving channels and the slide grooves.

Further benefits and advantages of the present invention will become apparent after a careful reading of the detailed description with appropriate reference to the accompanying drawings.

DETAILED DESCRIPTION OF THE INVENTION

Figure 1:
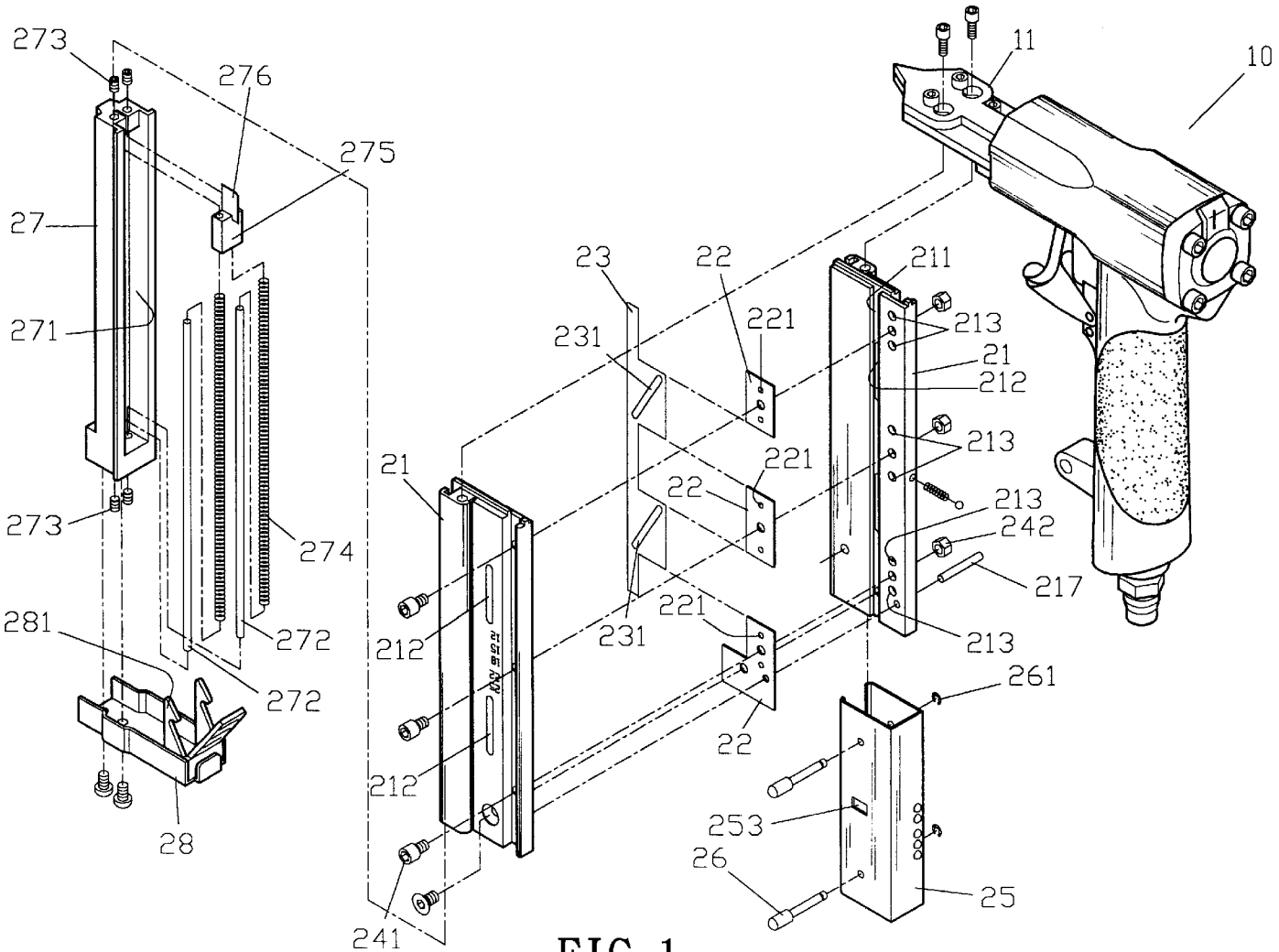
FIG. 1 PRIOR ART
FIG. 1 is an exploded view of a conventional nail magazine structure for a nail ejection gun in accordance with the prior art.
Figure 2:
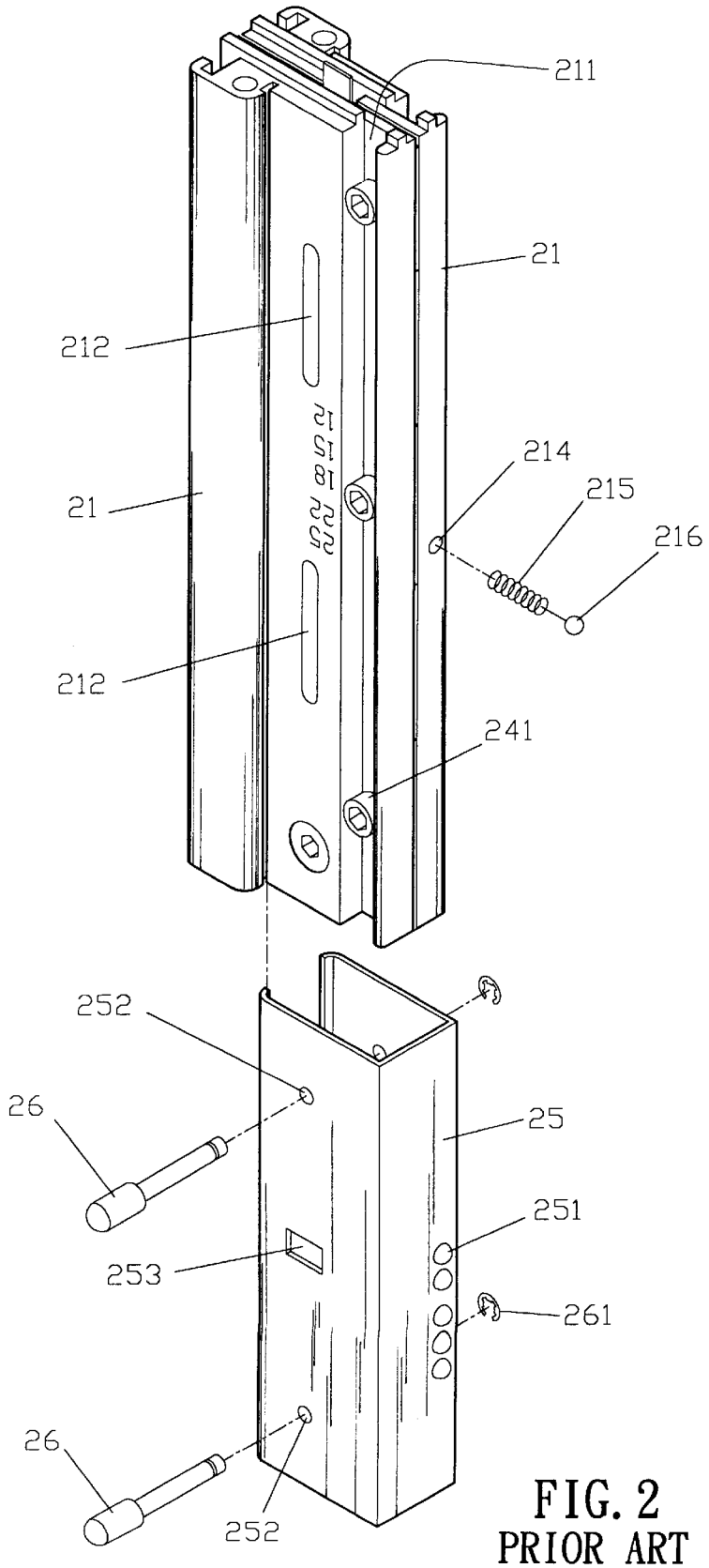
FIG. 2 PRIOR ART
FIG. 2 is a partially enlarged view of the conventional nail magazine structure as shown in FIG. 1.
Figure 3:
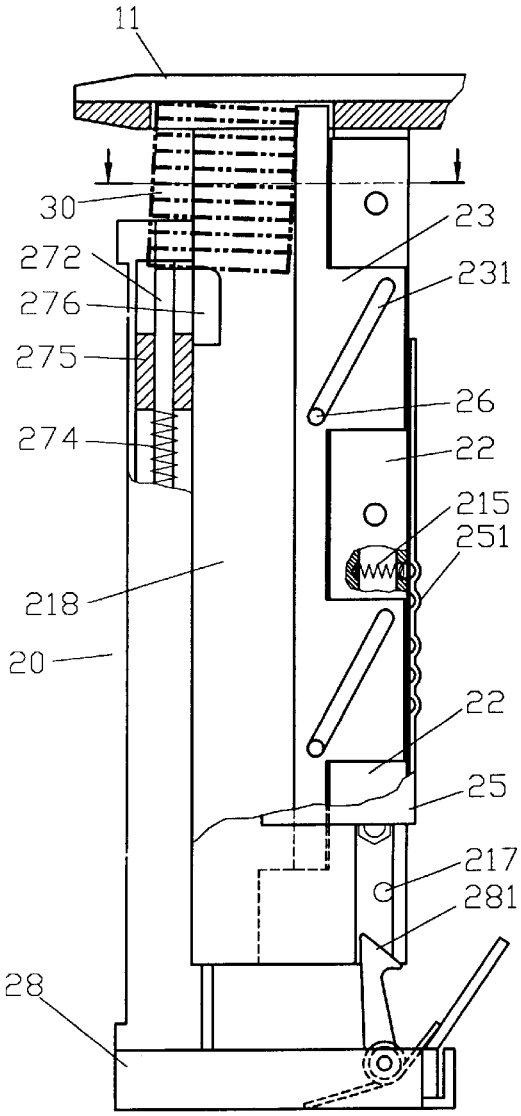
FIG. 3 PRIOR ART
FIG. 3 is a front plan cross-sectional assembly view of the conventional nail magazine structure as shown in FIG. 1.
Figure 5:
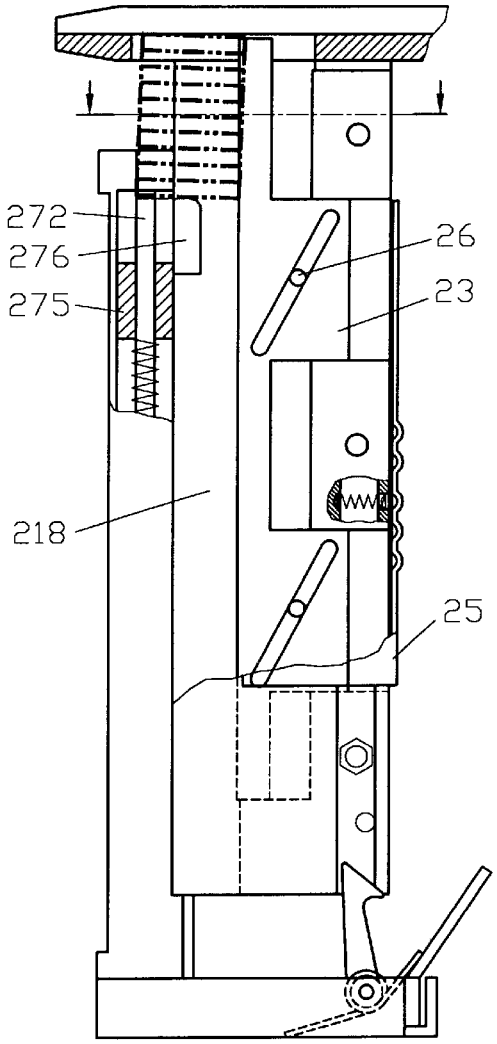
FIG. 5 PRIOR ART
FIG. 5 is an operational view of the conventional nail magazine structure as shown in FIG. 3.
Figure 7:
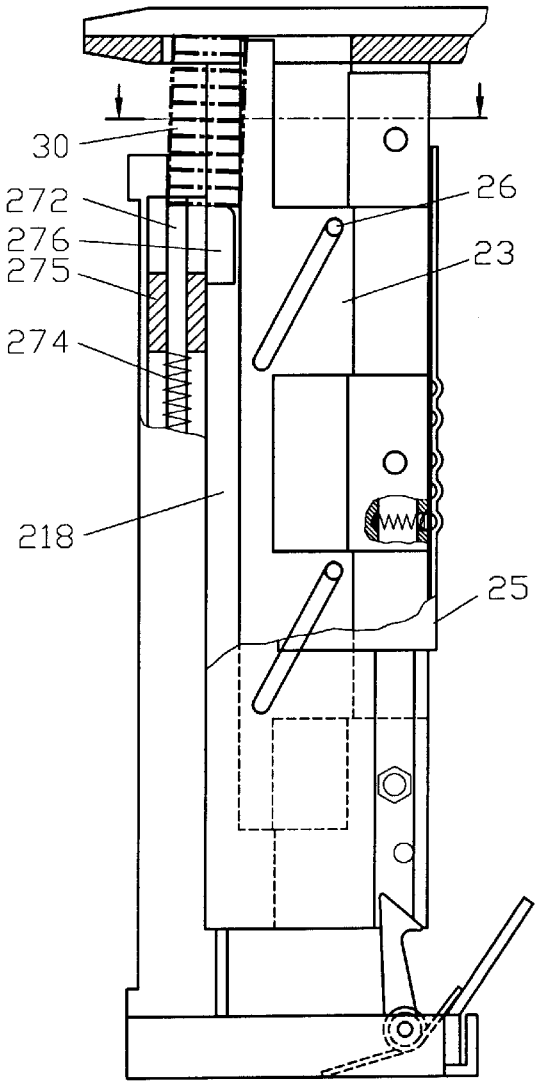
FIG. 7 PRIOR ART
FIG. 7 is an operational view of the conventional nail magazine structure as shown in FIG. 5.
Figure 4:
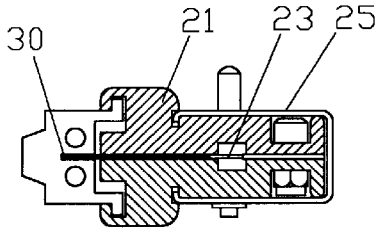
FIG. 4 PRIOR ART
FIG. 4 is a top plan cross-sectional view of the conventional nail magazine structure as shown in FIG. 3.
Figure 6:
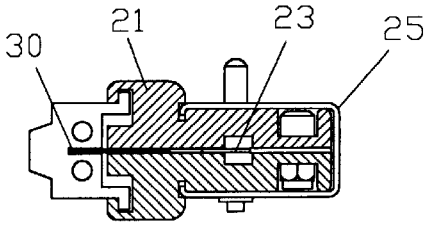
FIG. 6 PRIOR ART
FIG. 6 is a top plan cross-sectional view of the conventional nail magazine structure as shown in FIG. 5.
Figure 8:
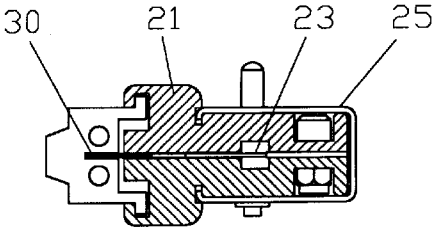
FIG. 8 PRIOR ART
FIG. 8 is a top plan cross-sectional view of the conventional nail magazine structure as shown in FIG. 7.
Figure 9:
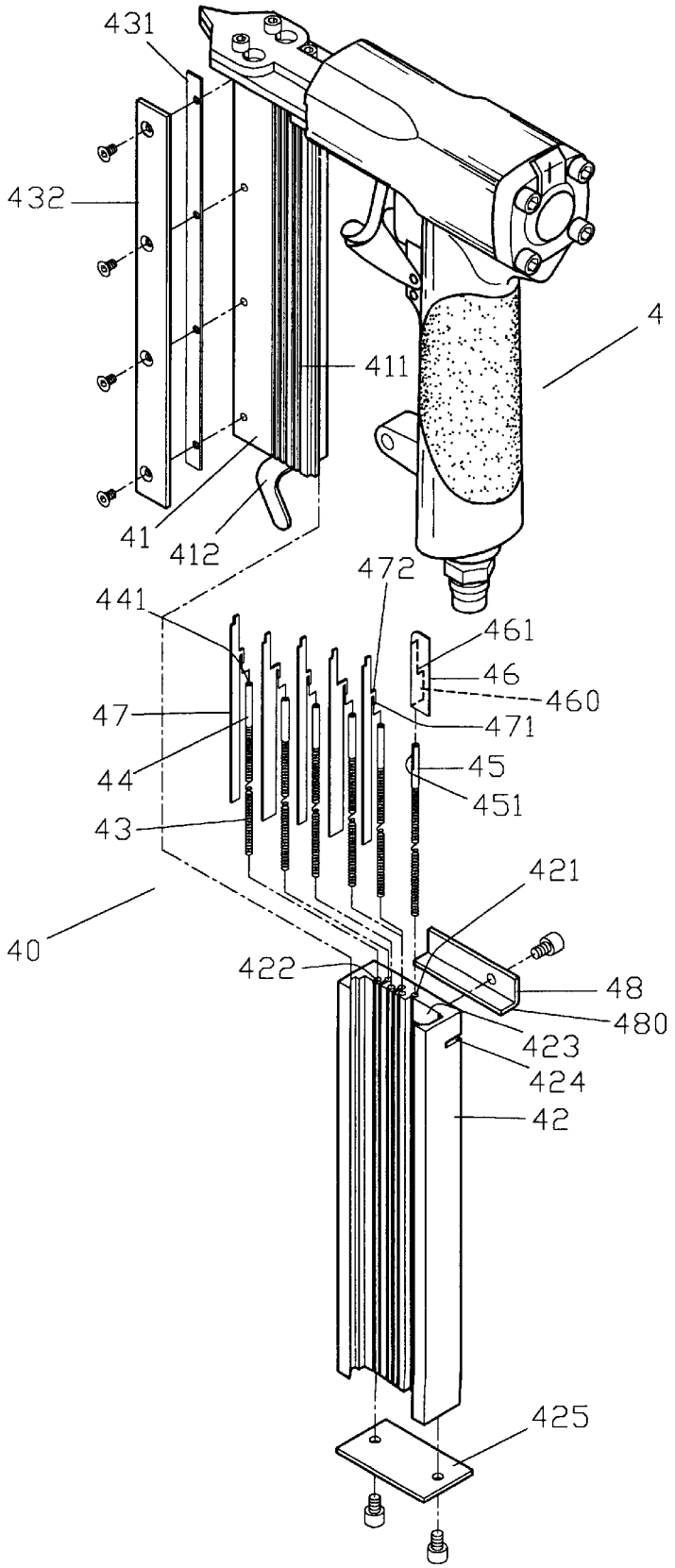
FIG. 9 is an exploded view of a nail magazine structure for a nail ejection gun in accordance with the present invention.
Figure 10:
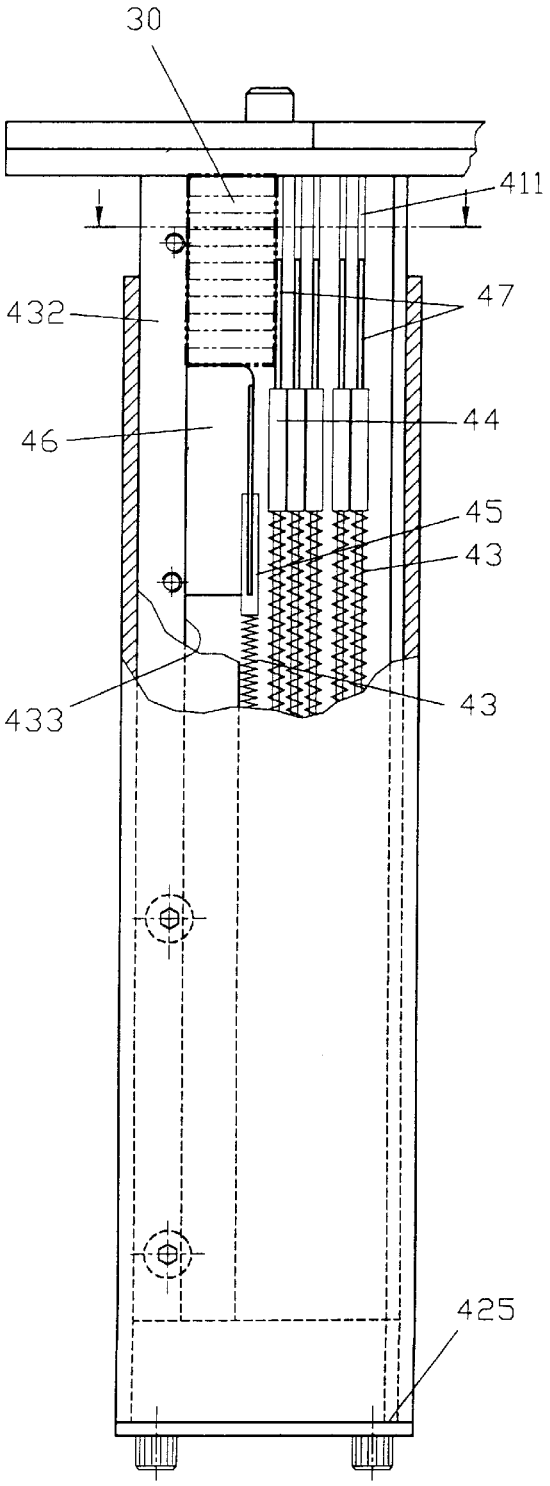
FIG. 10 is a front plan cross-sectional assembly view of the nail magazine structure as shown in FIG. 9.
Figure 11:
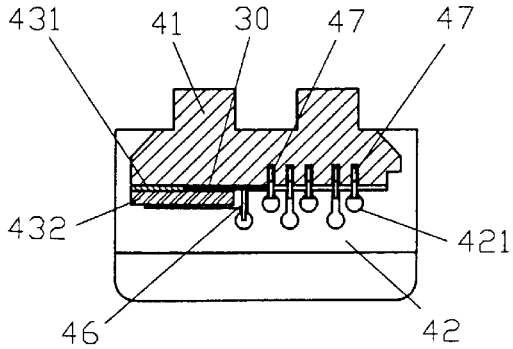
FIG. 11 is a top plan cross-sectional view of the nail magazine structure as shown in FIG. 10.

Referring to the drawings and initially to FIGS. 9–11, a nail magazine structure 40 for a nail ejection gun 4 in accordance with the present invention comprises a first nail magazine 41, and a second nail magazine 42.

The first nail magazine 41 defines a plurality of longitudinal slide grooves 411 therein. An elongated catch piece 431 is secured on the first nail magazine 41, and an elongated cover plate 432 is secured on the catch piece 431 for securing the catch piece 431 on the first nail magazine 41. A nail receiving chamber 433 is defined between the first nail magazine 41, the catch piece 431 and the cover plate 432 for receiving an array of nails 30 therein.

As shown in FIG. 9, the second nail magazine 42 is inverted by an angle of one hundred and eighty degrees (180°) for clearly indicating the inside configuration of the second nail magazine 42.

The second nail magazine 42 is secured on the first nail magazine 41 and defines a longitudinal receiving recess 423 for receiving the catch piece 431 and the cover plate 432 therein. The second nail magazine 42 also defines a plurality of spring receiving grooves 421 each aligning with each of the slide grooves 411 of the first nail magazine 41, and each of the spring receiving grooves 421 defines a receiving channel 422 therein.

A cover plate 425 is secured on the bottom of the second nail magazine 42 for sealing the bottom of the second nail magazine 42. The second nail magazine 42 is slidably mounted on the first nail magazine 41, and the first nail magazine 41 includes an elastic positioning piece 412 extending outward from the bottom thereof and securely coupled with the second nail magazine 42.

A plurality of springs 43 are each received in a respective one of the spring receiving grooves 421. A primary push pin 45 is secured on an outermost one of the springs 43 to be pressed upward by the spring 43. An L-shaped nail push piece 46 is secured on the primary push pin 45 to be pushed upward by the primary push pin 45 to move upward in the nail receiving chamber 433 to press the nails 30 upward.

A plurality of push pins 44 are each secured on a respective one of the springs 43 to be pressed upward by the springs 43. A plurality of nail limit pieces 47 are each secured on a respective one of the push pins 44 to be pushed upward by the push pins 44 to move upward in the receiving channels 422 and the slide grooves 411 for limiting the nails 30.

The primary push pin 45 defines a longitudinal positioning slit 451 therein, and the nail push piece 46 includes an extension 460 secured in the positioning slit 451. Each of the push pins 44 defines a positioning hole 441 therein, and each of the nail limit pieces 47 includes an extension 471 secured in the positioning hole 441.

The extension 460 of the nail push piece 46 is provided with a first abutting surface 461, and the extension 471 of each of the nail limit pieces 47 is provided with a second abutting surface 472. The second nail magazine 42 has an upper portion defining a receiving slot 424 connecting to the spring receiving grooves 421. The nail magazine structure further comprises an L-shaped limit plate 48 secured on the upper portion of the second nail magazine 42 and having a horizontal limit piece 480 received in the receiving slot 424 to abut the first abutting surface 461 and the second abutting surface 472 for limiting a further upper movement of the nail push piece 46 and the nail limit pieces 47, thereby preventing the nail push piece 46 and the nail limit pieces 47 from detaching from the second nail magazine 42.

In practice, referring to FIGS. 10 and 11 with reference to FIG. 9, the nails 30 are initially received in the nail receiving chamber 433, and are pressed upward by the nail push piece 46. The nails as shown in FIG. 10 have a shorter length whereby the nail limit pieces 47 cannot touch the nails so that the nail limit pieces 47 will directly extend upward to their extreme position, wherein the nail limit piece 47 adjacent to the nails 30 functions to limit the sideward movement of the nails 30 so that the nails 30 are moved upward in the nail receiving chamber 433 by the nail push piece 46 without a possibility of moving sideward.

Figure 12:
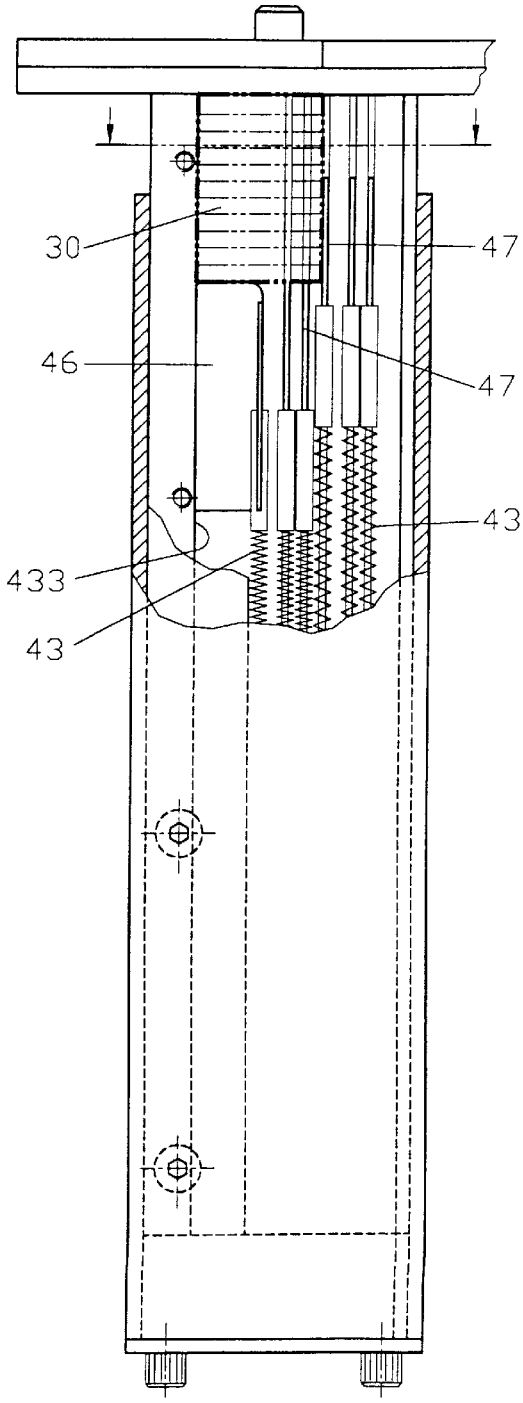
FIG. 12 is a front plan cross-sectional assembly view of the nail magazine structure as shown in FIG. 9.
Figure 13:
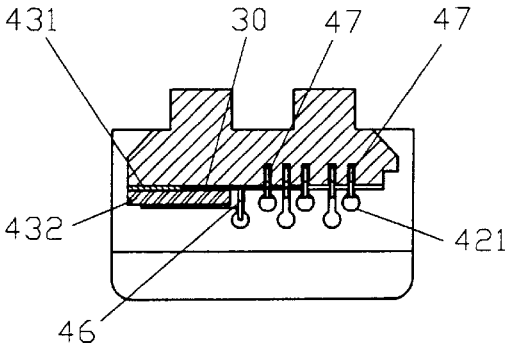
FIG. 13 is a top plan cross-sectional view of the nail magazine structure as shown in FIG. 12.

Referring now to FIGS. 12 and 13 with reference to FIG. 9, the nails 30 having a longer length will extend some of the nail limit pieces 47. In such a manner, some of the nail limit pieces 47 are used for pressing and retaining the nails 30, thereby facilitating the upward movement of the nails 30, and the nail limit piece 47 adjacent to the nails 30 functions to limit the sideward movement of the nails 30 so that the nails 30 are moved upward in the nail receiving chamber 433 by the nail push piece 46 without a possibility of moving sideward.

Figure 14:
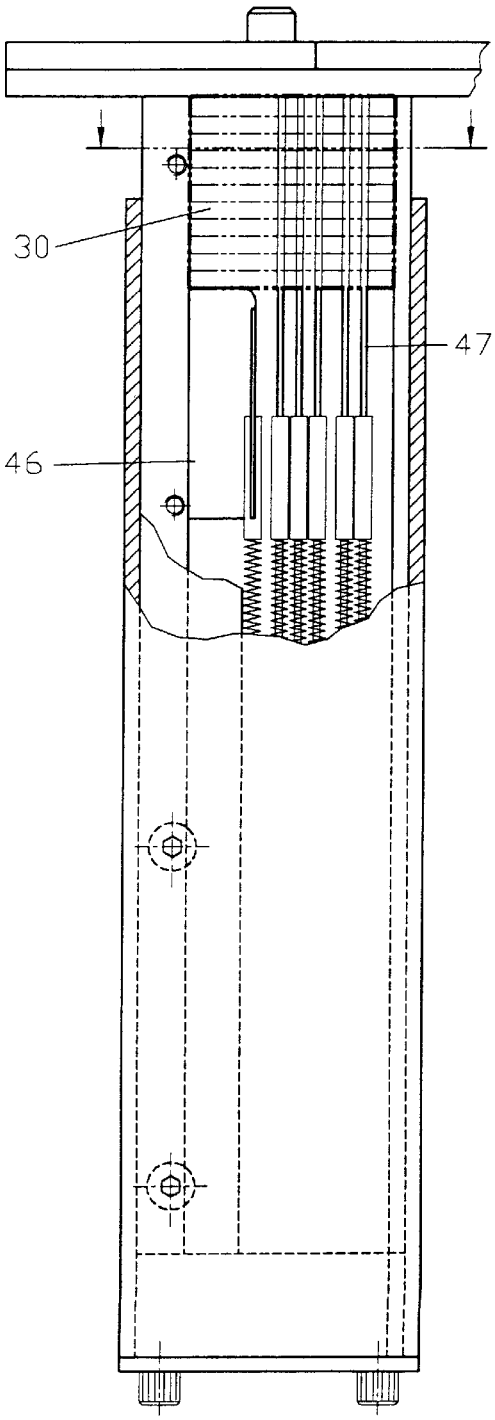
FIG. 14 is a front plan cross-sectional assembly view of the nail magazine structure as shown in FIG. 9.
Figure 15:
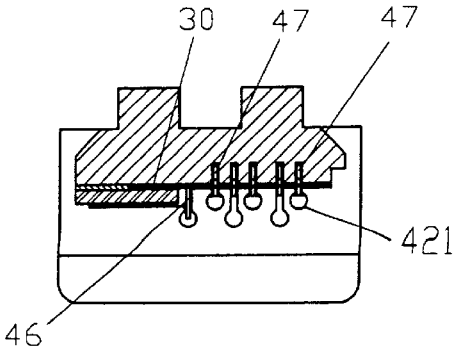
FIG. 15 is a top plan cross-sectional view of the nail magazine structure as shown in FIG. 14.

Referring now to FIGS. 14 and 15 with reference to FIG. 9, the nails 30 having the longest length will entirely extend all of the nail limit pieces 47. In such a manner, the nail limit pieces 47 are used for pressing and retaining the nails 30, thereby facilitating the upward movement of the nails 30.

Accordingly, the nails can be directly placed into the nail receiving chamber 433 without having to previously inspect the length of the nails 30 for adjusting the width of the nail receiving chamber 433.

In addition, the nail limit pieces 47 can be used for limiting the sideward movement of the nails 30, thereby preventing the nails 30 from moving sideward, and can also be used for pressing and retaining the nails 30, thereby facilitating the upward movement of the nails 30.

Further, the nails 30 are retained by the nail limit pieces 47, and the bottom of the nails 30 are pressed by the nail push piece 46 so that the nails 30 are moved upward in a horizontal manner without moving in an oblique manner so that the nails 30 can be normally operated by the nail ejection gun 4.

It should be clear to those skilled in the art that further embodiments may be made without departing from the scope of the present invention.

What is claimed is:

1. A nail magazine structure for a nail ejection gun comprising:

a first nail magazine (41) defining a plurality of longitudinal slide grooves (411) therein, an elongated catch piece (431) secured on said first nail magazine (41), an elongated cover plate (432) secured on said catch piece (431) for securing said catch piece (431) on said first nail magazine (41), a nail receiving chamber (433) defined between said first nail magazine (41), said catch piece (431) and said cover plate (432);

a second nail magazine (42) secured on said first nail magazine (41) and defining a plurality of spring receiving grooves (421) each aligning with each of said slide grooves (411) of said first nail magazine (41), each of said spring receiving grooves (421) defining a receiving channel (422) therein;

a plurality of springs (43) each received in a respective one of said spring receiving grooves (421);

a primary push pin (45) secured on a first one of said springs (43) to be pressed upward by said spring (43);

a nail push piece (46) secured on said primary push pin (45) to be pushed upward by said primary push pin (45) to move upward in said nail receiving chamber (433);

a plurality of push pins (44) each secured on a respective one of said springs (43) to be pressed upward by said springs (43); and a plurality of nail limit pieces (47) each secured on a respective one of said push pins (44) to be pushed upward by said push pins (44) to move upward in said receiving channels (422) and said slide grooves (411).

2. The nail magazine structure in accordance with claim 1, further comprising a cover plate (425) secured on a bottom of said second nail magazine (42) for sealing said bottom of said second nail magazine (42).

3. The nail magazine structure in accordance with claim 2, wherein said second nail magazine (42) is slidably mounted on said first nail magazine (41), and said first nail magazine (41) includes an elastic positioning piece (412) extending outward from a bottom thereof and securely coupled with said second nail magazine (42).

4. The nail magazine structure in accordance with claim 1, wherein said second nail magazine (42) defines a longitudinal receiving recess (423) for receiving said catch piece (431) and said cover plate (432) therein.

5. The nail magazine structure in accordance with claim 1, wherein said primary push pin (45) defines a longitudinal positioning slit (451) therein, and said nail push piece (46) includes an extension (460) secured in said positioning slit (451).

6. The nail magazine structure in accordance with claim 1, wherein each of said push pins (44) defines a positioning hole (441) therein, and each of said nail limit pieces (47) includes an extension (471) secured in said positioning hole (441).

7. The nail magazine structure in accordance with claim 1, wherein said nail push piece (46) is provided with a first abutting surface (461), each of said nail limit pieces (47) is provided with a second abutting surface (472), said second nail magazine (42) has an upper portion defining a receiving slot (424) connecting to said spring receiving grooves (421), and said nail magazine structure further comprises an L-shaped limit plate (48) secured on the upper portion of said second nail magazine (42) and having a horizontal limit piece (480) received in said receiving slot (424) to abut said first abutting surface (461) and said second abutting surface (472) for limiting a further upper movement of said nail push piece (46) and said nail limit pieces (47), thereby preventing said nail push piece (46) and said nail limit pieces (47) from detaching from said second nail magazine (42).

* * * * *